US009944373B1

(12) United States Patent
Kollock et al.

(10) Patent No.: US 9,944,373 B1
(45) Date of Patent: Apr. 17, 2018

(54) ARRANGEMENTS FOR LUBRICATING OUTBOARD MARINE ENGINES

(71) Applicant: Brunswick Corporation, Lake Forest, IL (US)

(72) Inventors: Mark Kollock, Oshkosh, WI (US); David J. Belter, Oshkosh, WI (US); Gregg D. Langenfeld, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 72 days.

(21) Appl. No.: 15/254,127

(22) Filed: Sep. 1, 2016

(51) Int. Cl.

| | |
|---|---|
| ***F01M 1/06*** | (2006.01) |
| ***B63H 20/00*** | (2006.01) |
| ***F02B 61/04*** | (2006.01) |
| ***F02B 75/00*** | (2006.01) |

(52) U.S. Cl.
CPC ..... *B63H 20/002* (2013.01); *F01M 1/06* (2013.01); *F02B 61/045* (2013.01); *F02B 75/005* (2013.01); *F01M 2001/064* (2013.01)

(58) Field of Classification Search
CPC ..... B63H 20/001; B63H 20/002; F01M 1/06; F01M 2001/064; F01M 9/103; F02B 61/045; F02B 75/005
See application file for complete search history.

(56) References Cited

U.S. PATENT DOCUMENTS

| | | | | |
|---|---|---|---|---|
| 5,143,034 | A | 9/1992 | Hirose | |
| 5,937,812 | A | 8/1999 | Reedy et al. | |
| 6,338,324 | B1 | 1/2002 | Tanaka et al. | |
| 6,460,504 | B1 * | 10/2002 | Phillips | F01M 1/06 123/195 P |
| 6,920,856 | B2 | 7/2005 | Lee | |
| 7,322,327 | B1 | 1/2008 | Kim | |
| 7,434,572 | B2 | 10/2008 | Hutter et al. | |
| 7,673,604 | B2 | 3/2010 | Takane et al. | |
| 8,166,939 | B2 | 5/2012 | Lopez-Crevillen et al. | |
| 9,228,455 | B1 | 1/2016 | Belter et al. | |
| 2004/0011314 | A1 * | 1/2004 | Seader | F01M 1/06 123/90.34 |
| 2017/0107874 | A1 * | 4/2017 | Nakamura | F02B 61/045 |

* cited by examiner

*Primary Examiner* — Andrew Polay
(74) *Attorney, Agent, or Firm* — Andrus Intellectual Property Law, LLP

(57) ABSTRACT

An outboard marine engine comprises a vertically aligned bank of piston-cylinders; a camshaft that operates a plurality of valves for controlling flow of air with respect to the vertically aligned bank of piston-cylinders, the camshaft vertically extending between a lower camshaft end and an upper camshaft end; and a cam lobe at the upper camshaft end. Rotation of the camshaft causes the cam lobe to cam open an uppermost valve in the plurality of valves. A lubricant circuit extends through the camshaft and has a lubricant outlet located at the upper camshaft end. The lubricant outlet is configured to disperse lubricant onto the uppermost valve, which is located above an uppermost cam bearing bulkhead for the upper camshaft end.

21 Claims, 8 Drawing Sheets

ARRANGEMENTS FOR LUBRICATING OUTBOARD MARINE ENGINES

FIELD

The present disclosure relates to marine engines, and particularly to outboard marine engines having dual overhead camshaft arrangements.

BACKGROUND

U.S. Pat. No. 9,228,455 is incorporated herein by reference in entirety and discloses a marine engine for an outboard motor comprising a bank of piston-cylinders, an intake camshaft that operates intake valves for controlling inflow of air to the bank of piston-cylinders, an exhaust camshaft that operates exhaust valves for controlling outflow of exhaust gas from the bank of piston-cylinders, and a cam phaser disposed on one of the intake camshaft and exhaust camshaft. The cam phaser is connected to and adjusts a timing of operation of the other of the intake camshaft and exhaust camshaft with respect to the one of the intake camshaft and exhaust camshaft.

U.S. Pat. No. 7,673,604 discloses a valve mechanism that drives an exhaust valve with a valve lifter and an exhaust camshaft. Oil is supplied to a journal surface of the camshaft and a bearing supporting the camshaft journal surface through an axial oil passage formed in the camshaft. The bearing is defined by a cam bucket and a bearing main body. An oil collecting recess is defined between cam bucket and the bearing main body. An auxiliary delivery passage extends from the oil collecting recess to a sidewall of the bearing that is located adjacent to the valve lifter. A guide wall is formed in the sidewall to lead oil from an opening of the auxiliary delivery passage to a part of the valve lifter that generates a striking noise in the absence of buffering oil.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, an outboard marine engine comprises a vertically aligned bank of piston-cylinders; a camshaft that operates a plurality of valves for controlling flow of air with respect to the vertically aligned bank of piston-cylinders, the camshaft vertically extending between a lower camshaft end and an upper camshaft end; and a cam lobe located at the upper camshaft end. Rotation of the camshaft causes the cam lobe to operate an uppermost valve in the plurality of valves. A lubricant circuit extends through the camshaft and has a lubricant outlet located at the upper camshaft end. The lubricant outlet is configured to disperse lubricant onto the uppermost valve, and particularly onto a valve bucket associated with the uppermost valve, which is located above an uppermost cam bearing bulkhead for the upper camshaft end.

BRIEF DESCRIPTION OF THE DRAWINGS

The present disclosure includes the following Figures. The same numbers are used throughout the Figures to reference like features and like components.

DETAILED DESCRIPTION OF THE DRAWINGS

FIGS. 1-4 are taken from the above-incorporated U.S. Pat. No. 9,228,455. The following description of FIGS. 1-4 is also taken from U.S. Pat. No. 9,228,455.

Figure 1:
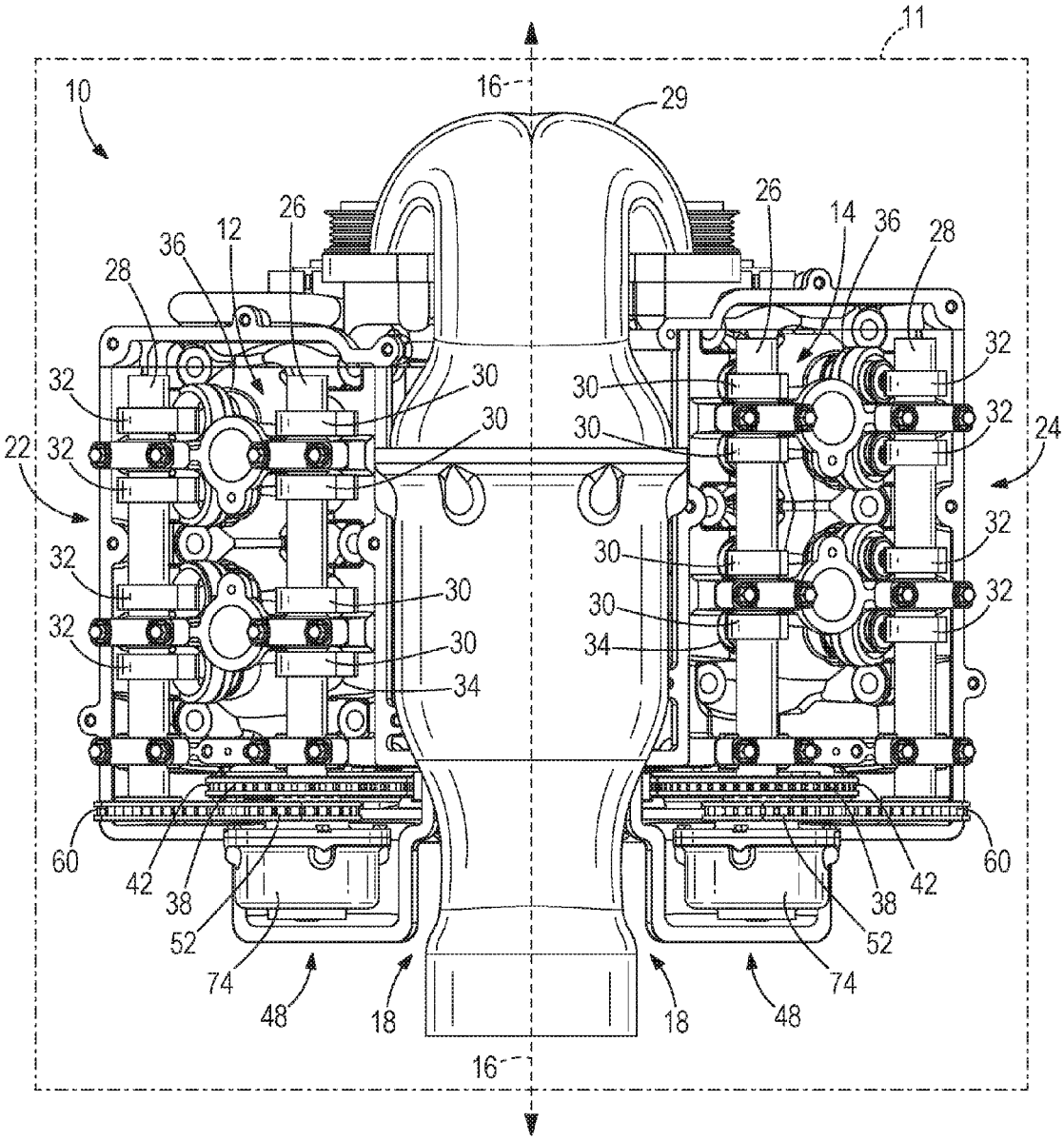
FIG. 1 is a rear view of a marine engine.
Figure 2:
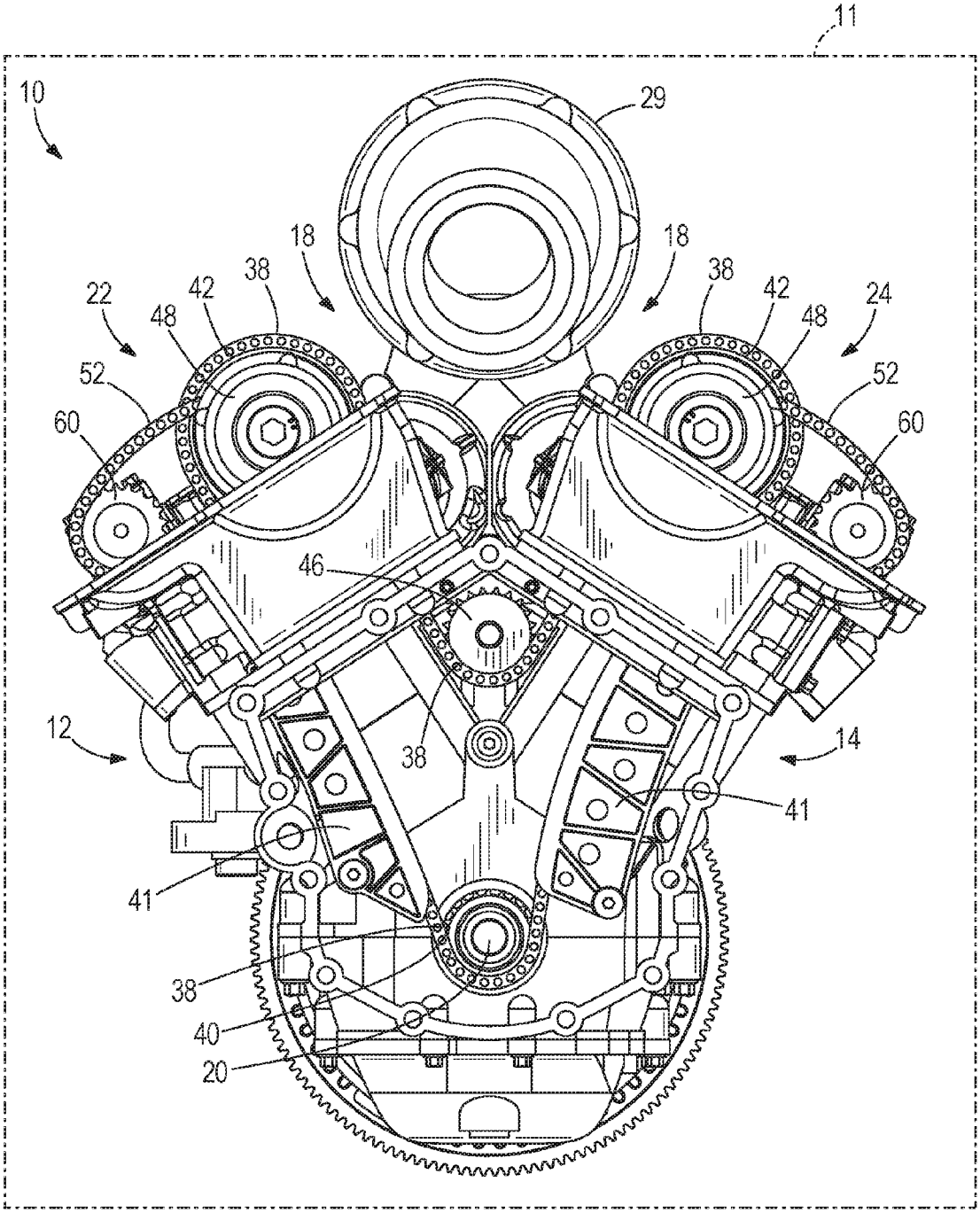
FIG. 2 is a bottom view of the marine engine shown in FIG. 1.
Figure 4:
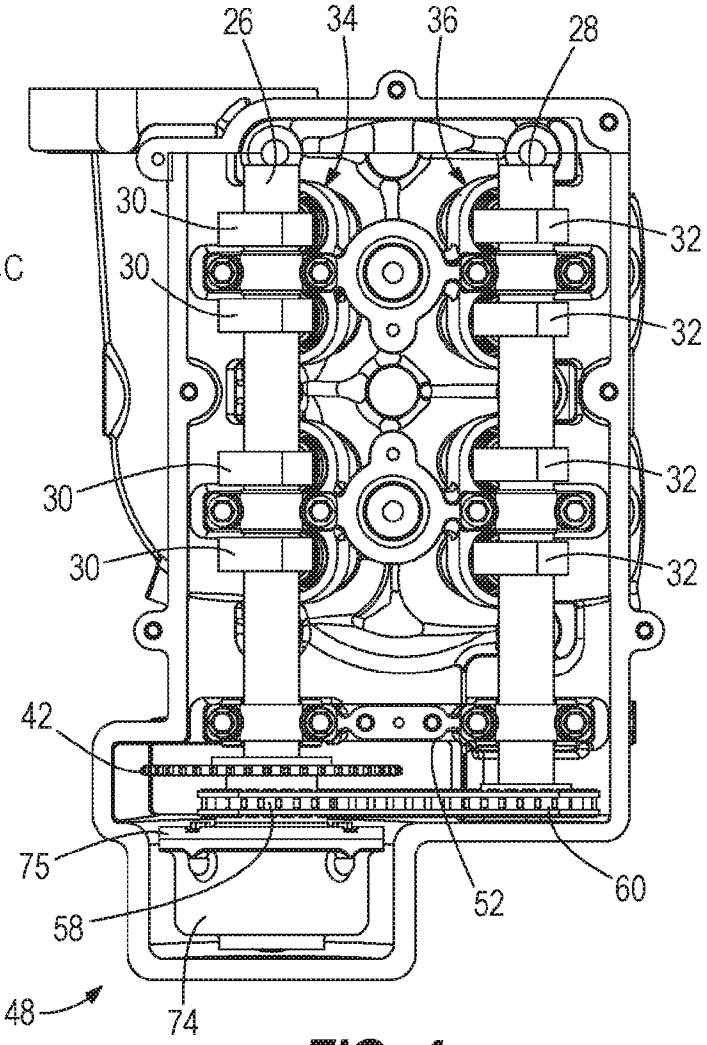
FIG. 4 is a view of one of the dual overhead cam arrangements.

FIGS. 1-2 depict a marine internal combustion engine 10 for an outboard motor 11. The engine 10 has first and second banks of piston-cylinders 12, 14 that are disposed along a vertical, longitudinal axis 16. The first and second banks of piston-cylinders 12, 14 extend transversely from each other and transversely from the longitudinal axis 16 in a V-shape (see FIG. 2) so as to define a valley 18 there between. As is conventional, combustion of air and fuel in the first and second banks of piston-cylinders 12, 14 causes reciprocation of pistons (not shown) in the banks of piston-cylinders 12, 14, which via connecting rods (not shown), causes rotation of a crankshaft 20 about the longitudinal axis 16.

FIGS. 1-4 depict dual overhead cam arrangements 22, 24 that are disposed on each of the first and second banks of piston-cylinders 12, 14. The dual overhead cam arrangements 22, 24 are configured such that rotation of the crankshaft 20 (see FIG. 3, arrows A) about the longitudinal axis 16 allows flow of intake air to the first and second banks of piston-cylinders 12, 14 and allows flow of exhaust gas from the first and second banks of piston-cylinders 12, 14. More specifically, each dual overhead cam arrangement 22, 24 includes an exhaust camshaft 26 and an intake camshaft 28. The exhaust camshaft 26 and intake camshaft 28 extend parallel to each other and extend parallel to the longitudinal axis 16 shown in FIG. 1. As shown in FIGS. 1 and 2, the exhaust camshaft 26 is located closer to the valley 18 than the intake camshaft 28. Each of the intake and exhaust camshafts 26, 28 carries cam lobes 30, 32 that operate exhaust and intake valves 34, 36, respectively, on the first and second banks of piston-cylinders 12, 14. The exhaust valves 34 are located closer to the valley 18 than the intake valves 36. As explained further herein below, rotation of the crankshaft 20 (arrows A) causes rotation of the intake and exhaust camshafts 26, 28 (see FIG. 3, arrows B, C), which causes rotation of the cam lobes 30, 32, which in turn cams open the exhaust and intake valves 34, 36, respectively.

Continued rotation of the intake and exhaust camshafts 26, 28, further rotates the cam lobes 30, 32, which allows springs on the exhaust and intake valves 34, 36 to close the exhaust and intake valves 34, 36, respectively. This opening/closing cycle repeats during the combustion process to allow intake air into the piston-cylinders 12, 14 for combustion and to emit exhaust gas from the piston-cylinders 12, 14 for discharge. An exhaust conduit 29 carries exhaust gas from the piston-cylinders 12, 14.

Figure 3:
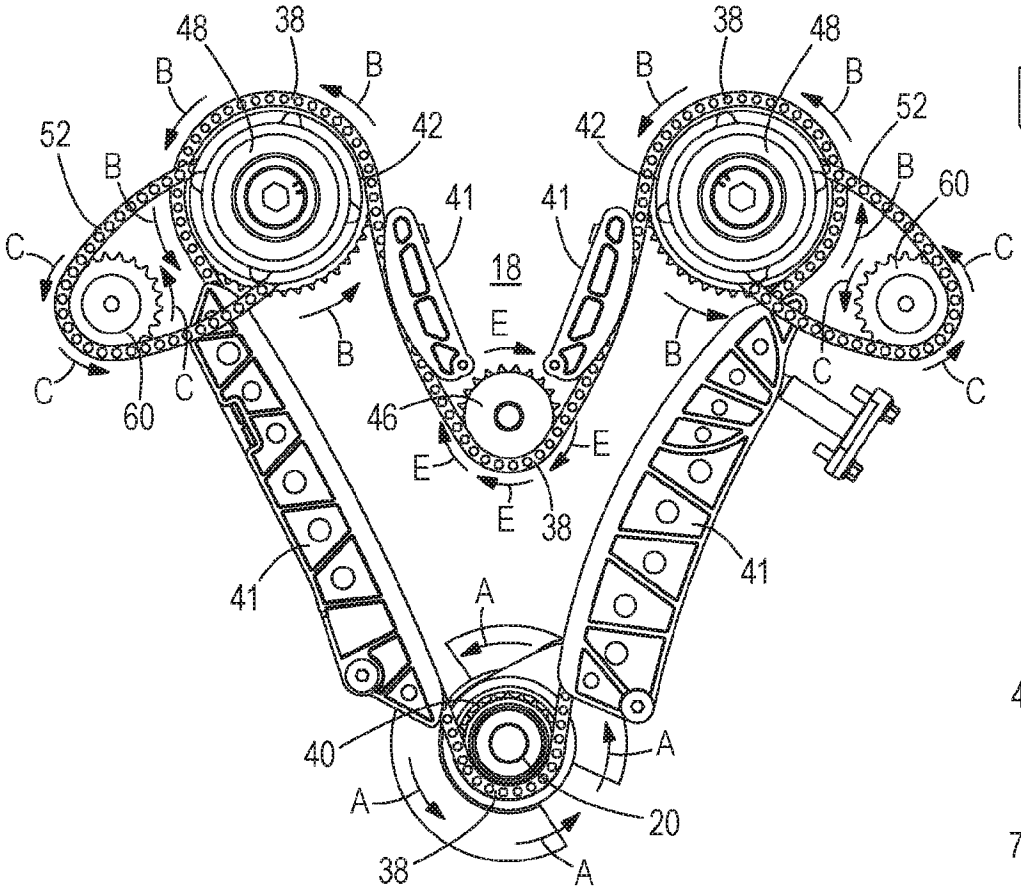
FIG. 3 is a view of a chain drive for the marine engine shown in FIG. 1, including a crankshaft and pair of dual overhead cam arrangements.

Referring to FIG. 3, combustion in the first and second banks of piston-cylinders 12, 14 causes rotation of the crankshaft 20 (arrows A), which in turn causes rotation of the exhaust camshafts 26 (arrows B). The crankshaft 20 is operatively connected to the exhaust camshafts 26 via a flexible connector, which in this example is a chain 38. The type of connector can vary and in certain examples can include a belt, gear and/or the like. The chain 38 is driven into movement by a drive sprocket 40, which is disposed on the crankshaft 20 and engaged with the chain 38. Movement of the chain 38 engages with sprockets 42 on the exhaust camshafts 26, thereby causing rotation of the exhaust camshafts 26 (arrows B) about their own axes. An idler sprocket 46 is located at a center of the valley 18. The idler sprocket 46 is engaged with and driven into rotation about its own axis (arrows E) by movement of the chain 38. The idler sprocket 46 supports movement of the chain 38. Movement of the chain is also supported by conventional chain guides 41.

In FIGS. 1-4, additional cam phaser-related features represented by reference characters 48, 52, 58, 60, 74, and 75 operate in accordance with the principles described in the above-incorporated U.S. Patent to cause phased rotational movement, for example shown by arrows C in FIG. 3. These and other features are more fully explained in the incorporated U.S. Patent. These features are not central to the present disclosure and thus, for brevity, are not further herein described.

During research and experimentation, the present inventors have determined that most intake and exhaust valve buckets associated with intake and exhaust valves in horizontally-oriented marine engines typically are adequately lubricated via cam bearing leakage. However the present inventors have found that in vertically-oriented marine engines, such as outboard marine engines, the valve buckets for the uppermost intake and exhaust valves typically are not adequately lubricated from cam bearing leakage. Instead, gravity causes the cam bearing leakage to flow away from the uppermost intake and exhaust valves, particularly at start-up and during initial operation of the engine. The lack of lubrication of the uppermost intake and exhaust valve buckets can lead to wear and potential breakdown. The present disclosure discloses the outcome of the present inventors' efforts to remedy this deficiency they found in the prior art.

Figure 5:
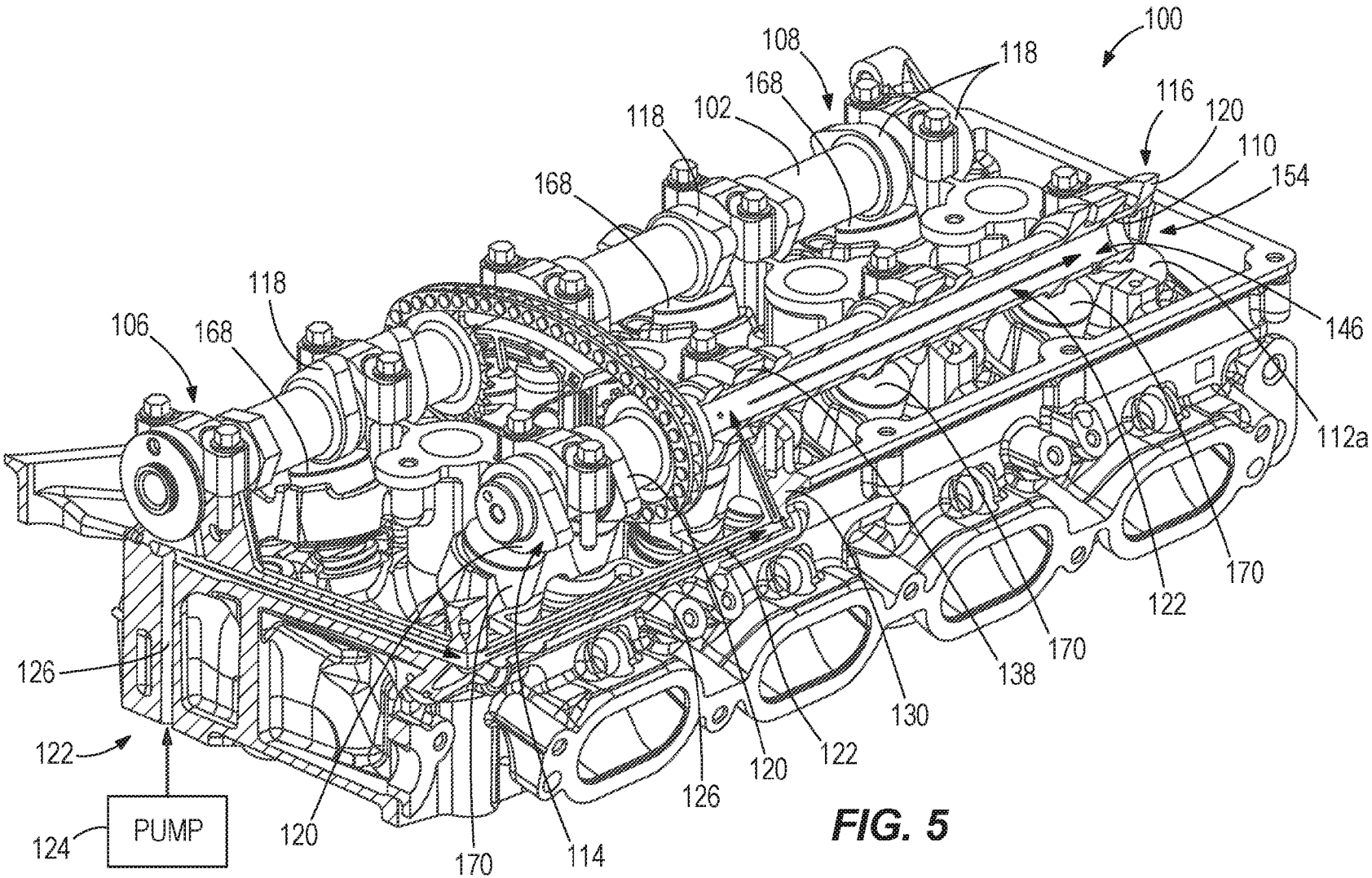
FIG. 5 is a perspective view of the marine engine, having a portion of the intake camshaft shown in section view.
Figure 6:
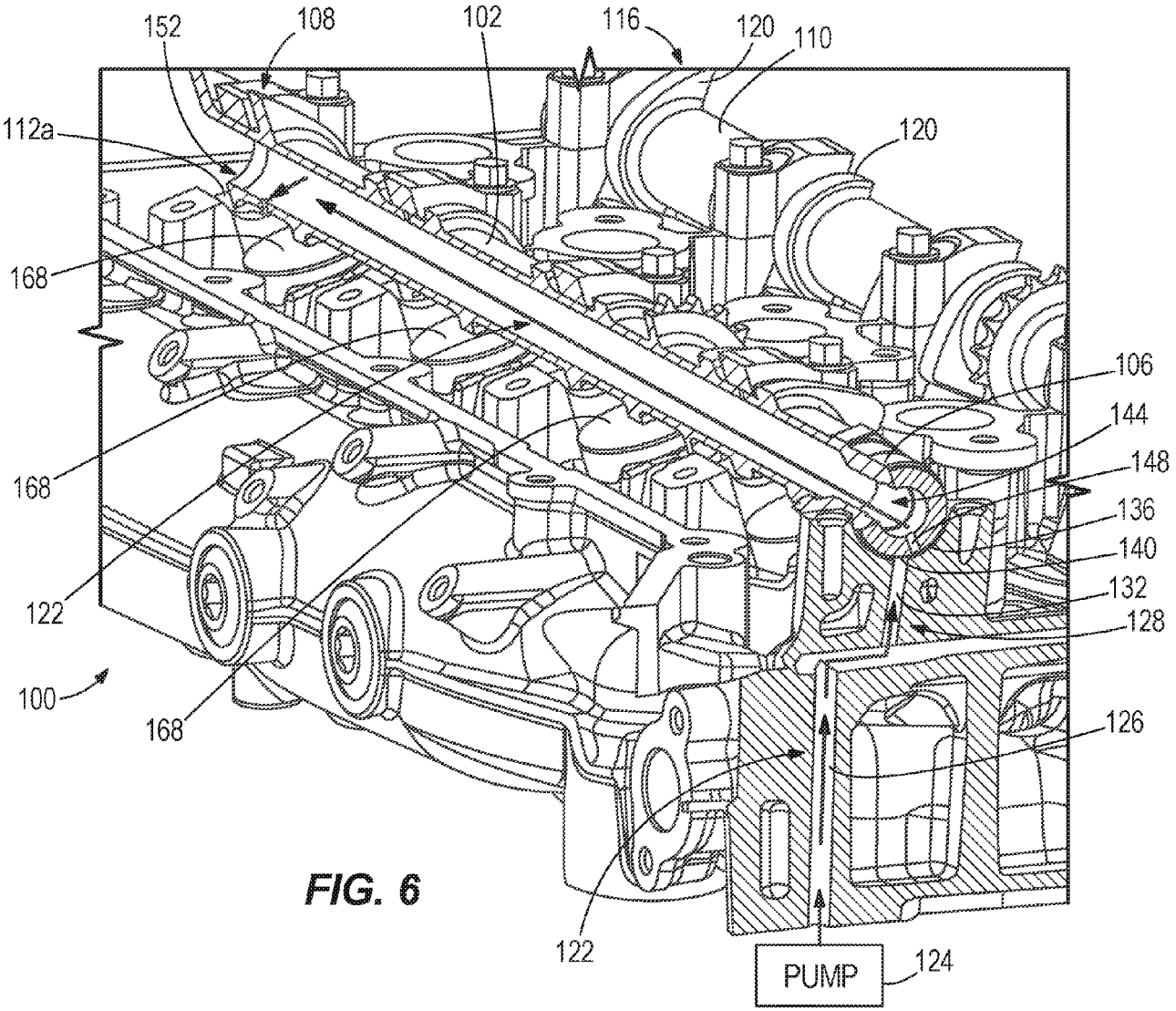
FIG. 6 is a perspective view of the marine engine having a portion of the exhaust camshaft shown in section view.

FIGS. 5 and 6 depict an exemplary cylinder head 100 according to the present disclosure. The cylinder head 100 is similar to the example shown in FIGS. 1-4 in that it is configured for an engine block having a vertically aligned bank of piston cylinders. (see, for example the vertically aligned banks of piston cylinders shown in FIG. 1). An exhaust camshaft 102 is located on the cylinder head 100. The exhaust camshaft 102 operates a plurality of exhaust valves 104 (see FIG. 8) that control flow of exhaust gas from the vertically aligned bank of piston cylinders. The exhaust camshaft 102 vertically extends between a lower exhaust camshaft end 106 and an upper exhaust camshaft end 108. Exhaust cam lobes 118 are disposed on the exhaust camshaft 102 and, as described further herein below, are configured such that rotation of the exhaust camshaft 102 causes each exhaust cam lobe 118 to operate (cam open) a corresponding exhaust valve 104 in the plurality of exhaust valves 104. An intake camshaft 110 is located on the cylinder head 100. The intake camshaft 110 operates a plurality of intake valves 112 (see FIG. 9) that control flow of intake air to the vertically aligned bank of piston cylinders. The intake camshaft 110 vertically extends between a lower intake camshaft end 114 and an upper intake camshaft end 116. Intake cam lobes 120 are disposed on the intake camshaft 110 and, as described further herein below, are configured such that rotation of the intake camshaft 110 causes the intake cam lobes 120 to cam open a respective intake valve 112 in the plurality of intake valves 112.

Figure 7:
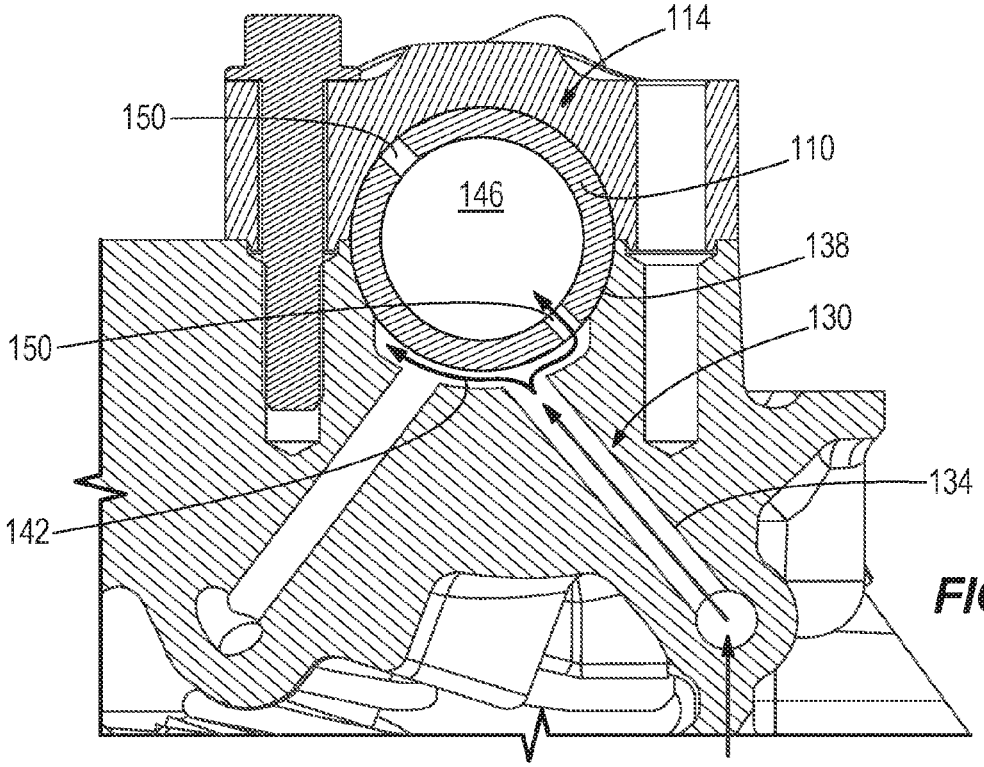
FIG. 7 is a section view of oil passages in a cam bearing for the intake camshaft and in the intake camshaft.

A lubricant circuit (portions referred to generally at reference number 122) extends in part through the exhaust camshaft 102 and through the intake camshaft 110. The lubricant circuit 122 is a circuitous pathway having a series of inlets, outlets, and passages for conveying lubricating fluid, such as oil, to valve buckets 168 on the exhaust valves 104, valve buckets 170 on the intake valves 112 and cam bearing bulkheads 164, 166, as further described herein below. Referring to FIGS. 5-7, the lubricant circuit 122 receives pressurized lubricant from a lubricant pump 124. The lubricant pump 124 is a conventional device that is configured to pump the lubricant from a lubricant source (e.g. a reservoir) located elsewhere in the outboard marine engine. The lubricant is pumped into an inlet passageway 126 formed in the cylinder head 100 to lubricant inlets 128, 130 for supplying the lubricant to the lower exhaust camshaft end 106 and the lower intake camshaft end 114, respectively. The lubricant inlets 128, 130 include a respective lubricant passageway 132, 134 formed in a respective cam bearing journal 136, 138. The lubricant passageways 132, 134 convey the lubricant from the inlet passageway 126 to a respective recess 140, 142 formed in the respective cam bearing journal 136, 138. The exhaust camshaft 102 and intake camshaft 110 each have a respective oil gallery 144, 146 formed therein for vertically conveying the lubricant there through. Pairs of diametrically opposite radial inlet holes 148 (only one shown), 150 are formed in the exhaust camshaft 102 and intake camshaft 110. The radial inlet holes 148, 150 are oriented 180° apart and are configured to open to the respective recess 140, 142 formed in the respective lower cam bearing journal 136, 138. The radial inlet holes 148, 150 are configured to open to the recesses 140, 142 in the lower cam bearing journal 136, 138, respectively, upon each 360 degree rotation of the respective intake and exhaust camshafts 102, 110, thereby intermittently allowing the lubricant to flow into the respective oil galleries 144, 146, under pressure from the pump 124. It should be noted that the above-described configuration can vary from what is described. For example, on the exhaust camshaft 102, it is possible to include only one hole 148. In this example, the oil passage 132 communicates with a groove formed 360° around the camshaft journal, which feeds the hole 148. Other configurations are possible within the scope of this disclosure.

Under pressure from pump 124, the lubricant flows vertically upwardly through the oil galleries 144, 146 from the lower exhaust camshaft end 106 and lower intake camshaft end 114 to the upper exhaust camshaft end 108 and upper intake camshaft end 116, respectively. Referring to FIGS. 8-11, lubricant outlets 152, 154 are located at the upper exhaust camshaft end 108 and upper intake camshaft end 116, respectively and are configured to disperse the lubricant at the location of and onto the uppermost exhaust valve 104*a* and at the location of and onto the upper most intake valve 112*a*, respectively. Referring to FIGS. 8-11, the lubricant outlets 152, 154 each have one or more radial outlet hole 156, 158. Each radial outlet hole 156, 158 opens to a respective lubricant passageway 160, 162 formed in an uppermost cam bearing bulkhead 164, 166 for supporting rotation of the respective exhaust and intake camshafts 102, 110. In this manner, the radial outlet holes 156, 158 are configured to intermittently disperse the lubricant from the oil galleries 144, 146 in the camshafts 102, 110 to the lubricant passageways 160, 162 in the uppermost cam bearing bulkheads 164, 166. It should be noted that the above-described configuration can vary from what is described. In some examples, the lubricant outlets 152 and/or 154 have pairs of diametrically opposite radial outlet holes 156, 158.

Figure 8:
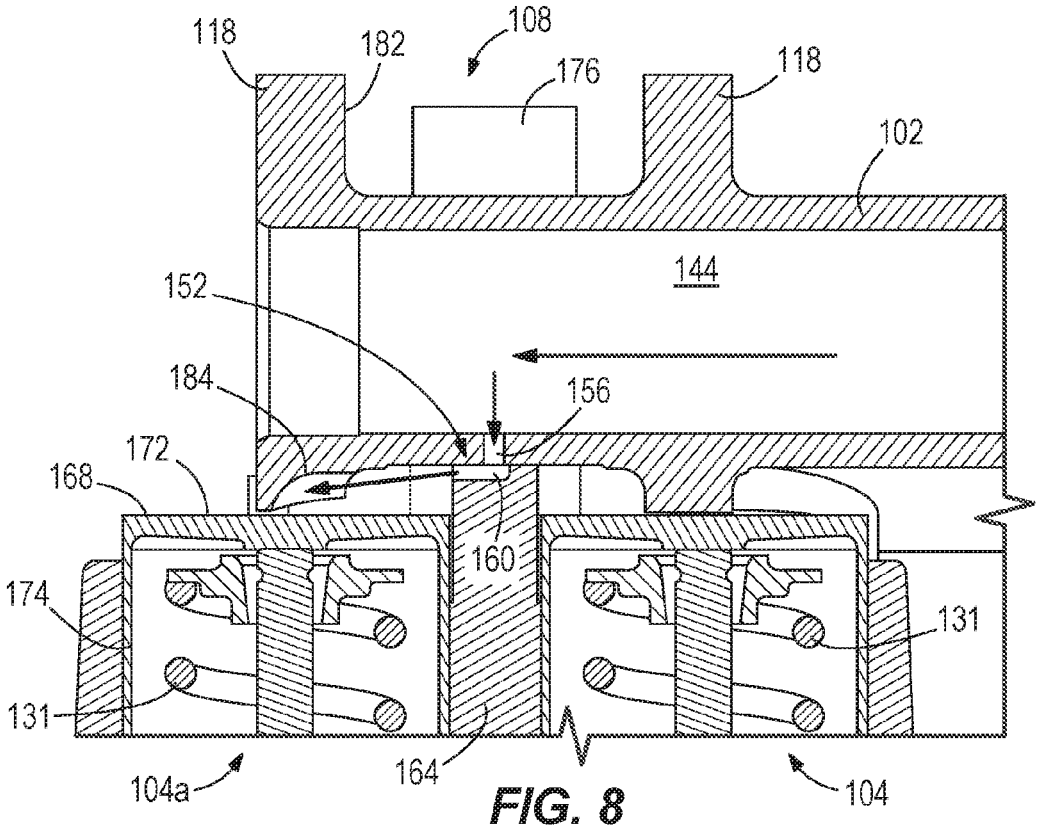
FIG. 8 is a section view of the vertically upper end of the exhaust camshaft and a top bucket on a vertically uppermost engine exhaust valve.
Figure 9:
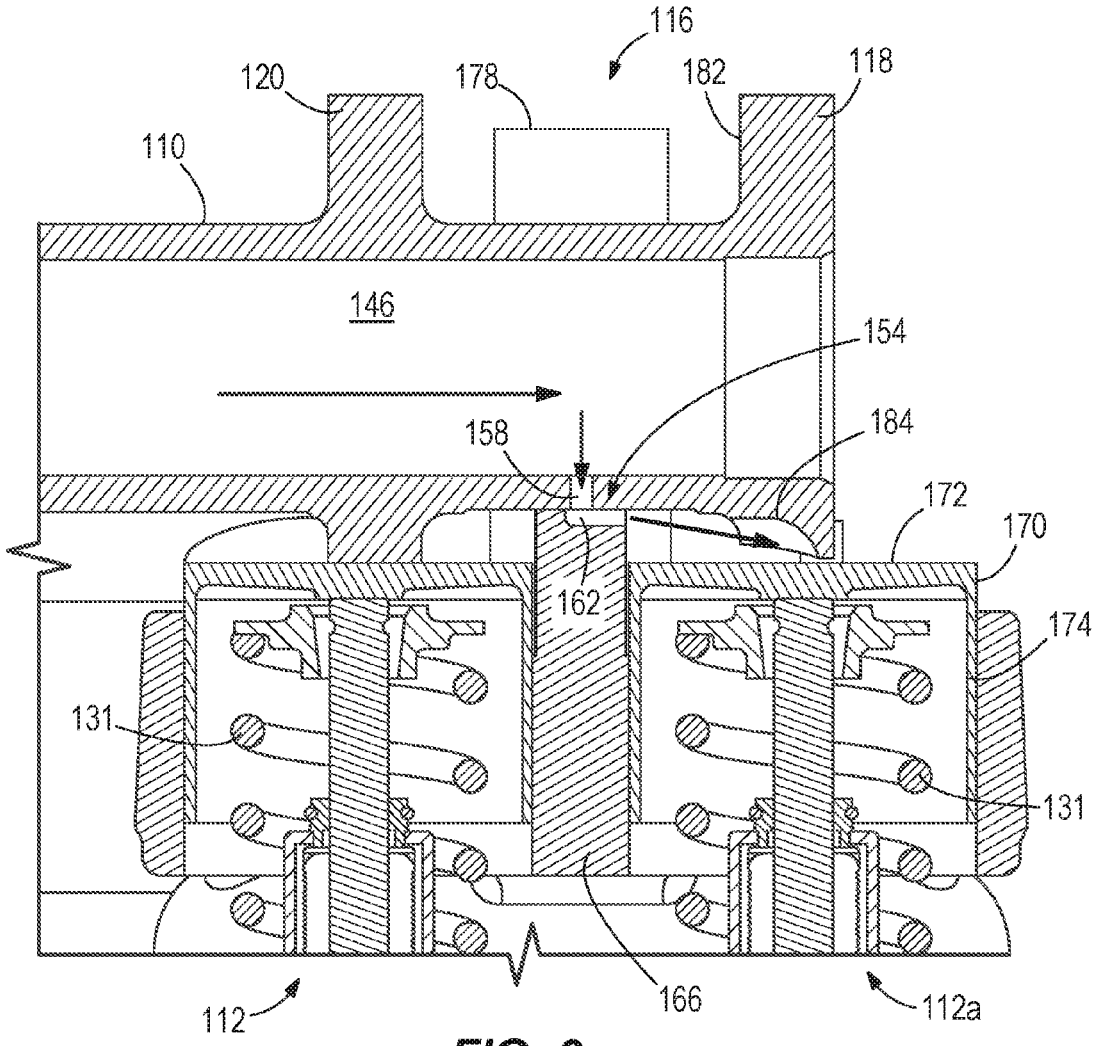
FIG. 9 is a section view of the vertically upper end of the intake camshaft and a valve bucket on a vertically uppermost engine intake valve.
Figure 10:
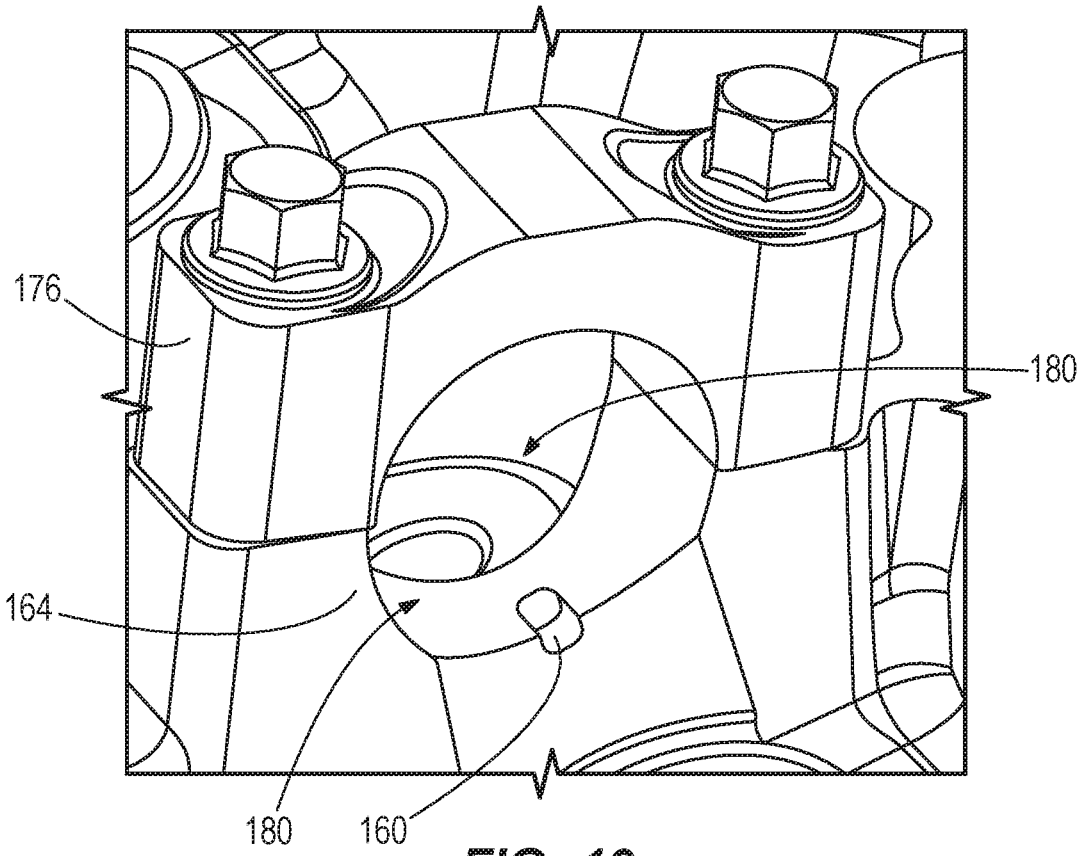
FIG. 10 is a perspective view of a cam cap and an upper cam bearing.

Referring to FIGS. 8 and 9, the uppermost exhaust valve 104*a* and uppermost intake valve 112*a* have valve buckets 168, 170 that are cammingly engaged by the respective cam lobes 118, 120 during rotation of the camshafts 102, 110. Rotation of the camshafts 102, 110 causes the cam lobes 118, 120 to cam the valve buckets 168, 170 against the bias of springs 131. The cam lobes 118, 120 and springs 131 operate together to open and close the respective valves 104*a*, 112*a*. The valve buckets 168, 170 have an end wall 172 and a perimeteral side wall 174. Advantageously, the lubricant outlets 152, 154 are configured to disperse the lubricant via the noted lubricant passageways 160, 162 in the uppermost cam bearing bulkheads 164, 166 onto the end wall 172 of the valve buckets 168, 170. Thus the lubricant is effectively dispersed onto the respective uppermost valves 104*a*, 112*a*, particularly onto the valve buckets 168, 170 at a location above the uppermost cam bearing bulkheads 164, 166 in an manner that enhances lubrication of the uppermost interface between the cam lobes 118, 120 and the valve buckets 168, 170.

Figure 11:
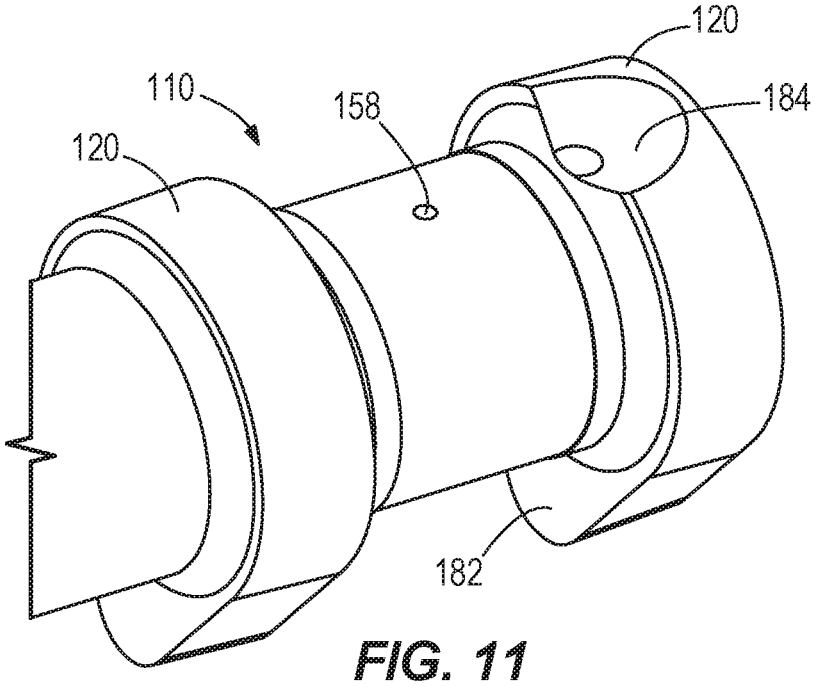
FIG. 11 is a perspective view of an upper camshaft end representative of the intake and exhaust camshafts.

Referring to FIGS. 8-11, the upper cam bearing bulkheads 164, 166 each have an upper cam cap 176, 178. The respective camshaft 102, 110 extends through a tunnel 180 formed between the upper cam cap 176, 178 and uppermost cam bearing bulkhead 164, 166. Each cam lobe 118, 120 that is located vertically above the upper cam cap 176, 178 and uppermost cam bearing bulkhead 164, 168 has a side wall 182 with a cut out 184 that permits the lubricant to intermittently pass from the lubricant passageway 160, 162 in the uppermost cam bearing bulkhead 164, 166 to the end wall 172 of the respective valve bucket 168, 170 during rotation of the respective camshaft 102, 110. The cam lobe 118, 120 has a teardrop-shaped cutout, as shown in FIG. 11.

Although not illustrated, certain modifications to the examples described herein above can be made within the spirit of the invention. In an alternate example, the lubricant passageway 160, 162 within the cam bearing bulkhead 164, 166 could be rotated to a different position, including a position where the lubricant passageway 160, 162 is partially or fully located within the cam bearing cap 114. Another example could include axially moving the radial outlet hole 156, 158 so that it no longer resides axially centered on the cam bearing bulkhead 164, 166. This could be done to minimize or eliminate the lubricant passageway 160, 162. Yet another modification could be made to the cam lobe, where a narrowed section of the cam lobe could be used in place of or in addition to a teardrop shaped cutout.

In the present description, certain terms have been used for brevity, clarity and understanding. No unnecessary limitations are to be inferred therefrom beyond the requirement of the prior art because such terms are used for descriptive purposes only and are intended to be broadly construed.

What is claimed is:

1. An outboard marine engine comprising:

a vertically aligned bank of piston-cylinders;

a camshaft that operates a plurality of valves for controlling flow of air with respect to the vertically aligned bank of piston-cylinders, the camshaft vertically extending between a lower camshaft end and an upper camshaft end;

a cam lobe at the upper camshaft end, wherein rotation of the camshaft causes the cam lobe to operate an uppermost valve in the plurality of valves;

an upper cam bearing bulkhead that supports rotation of the upper camshaft end; and a lubricant circuit extending through the camshaft and having a lubricant outlet located at the upper camshaft end, wherein the lubricant outlet is configured to disperse lubricant onto the uppermost valve which is located above the uppermost cam bearing bulkhead.

2. The outboard marine engine according to claim 1, wherein the uppermost valve comprises a valve bucket that is cammingly engaged by the cam lobe during rotation of the camshaft, and wherein the lubricant circuit is configured to disperse the lubricant onto the valve bucket.

3. The outboard marine engine according to claim 2, wherein the valve bucket comprises an end wall and a perimeteral sidewall, and wherein the lubricant outlet is configured to disperse the lubricant onto the end wall.

4. The outboard marine engine according to claim 1, wherein the lubricant outlet comprises a radial outlet hole in the camshaft.

5. The outboard marine engine according to claim 4, wherein the lubricant outlet comprises a lubricant passageway in the upper cam bearing bulkhead.

6. The outboard marine engine according to claim 5, wherein the radial outlet hole opens to the lubricant passageway in the upper cam bearing bulkhead upon each 360 degree rotation of the camshaft, thereby intermittently dispersing the lubricant from the camshaft to the lubricant passageway in the upper cam bearing bulkhead.

7. The outboard marine engine according to claim 5, wherein the radial outlet hole is one of a plurality of radial outlet holes in the camshaft that are angularly oriented apart from each other, wherein each radial outlet hole opens to the lubricant passageway in the upper cam bearing bulkhead upon each rotation of the camshaft, thereby intermittently dispersing the lubricant from the camshaft to the lubricant passageway in the upper cam bearing bulkhead.

8. The outboard marine engine according to claim 5, further comprising an upper cam cap on the upper cam bearing bulkhead, wherein the camshaft extends through a tunnel defined between the upper cam cap and the upper cam bearing bulkhead.

9. The outboard marine engine according to claim 8, wherein the cam lobe is located vertically above the upper cam cap and upper cam bearing bulkhead.

10. The outboard marine engine according to claim 9, wherein the cam lobe has a sidewall having a cutout that permits the lubricant to pass from the lubricant passageway in the upper cam bearing bulkhead to the uppermost valve during rotation of the camshaft.

11. The outboard marine engine according to claim 10, wherein the cam lobe comprises a teardrop-shaped cutout.

12. The outboard marine engine according to claim 1, wherein the lubricant circuit comprises a lubricant inlet at the lower camshaft end.

13. The outboard marine engine according to claim 12, wherein the lubricant inlet comprises a radial inlet hole in the camshaft.

14. The outboard marine engine according to claim 13, further comprising a lower cam bearing bulkhead that supports rotation of the lower camshaft end, wherein the lubricant inlet comprises a lubricant passageway in the lower cam bearing bulkhead.

15. The outboard marine engine according to claim 14, wherein the lubricant inlet further comprises a recess formed in the lower cam bearing bulkhead, and wherein the radial inlet hole is opened to the recess in the lower cam bearing bulkhead upon each 360 degree rotation of the camshaft, thereby intermittently allowing the lubricant to flow into the camshaft.

16. The outboard marine engine according to claim 14, wherein the lubricant inlet further comprises a recess formed in the lower cam bearing bulkhead, and wherein the radial inlet hole is one of a pair of radial inlet holes in the camshaft that are angularly oriented apart from each other, wherein each radial inlet hole opens to the recess in the lower cam bearing bulkhead upon each rotation of the camshaft, thereby intermittently allowing the lubricant to flow into the camshaft.

17. The outboard marine engine according to claim 12, further comprising a pump that pumps the lubricant to the lubricant inlet.

18. The outboard marine engine according to claim 1, wherein the camshaft comprises an intake camshaft and wherein the plurality of valves comprises plurality of intake valves for controlling inflow of air to the vertically aligned bank of piston-cylinders, the intake camshaft vertically extending between a lower intake camshaft end and an upper intake camshaft end.

19. The outboard marine engine according to claim 1, wherein the camshaft comprises an exhaust camshaft and wherein the plurality of valves comprises a plurality of exhaust valves for controlling outflow of exhaust gas from the vertically aligned bank of piston-cylinders, the lower camshaft end comprising a lower exhaust camshaft end and the upper camshaft end comprising an upper exhaust camshaft end.

20. An outboard marine engine, comprising:

a vertically aligned bank of piston-cylinders;

an exhaust camshaft that operates a plurality of exhaust valves for controlling flow of exhaust air with respect to the vertically aligned bank of piston-cylinders, the exhaust camshaft vertically extending between a lower exhaust camshaft end and an upper exhaust camshaft end;

an intake camshaft that operates a plurality of intake valves for controlling flow of intake air with respect to the vertically aligned bank of piston-cylinders, the intake camshaft vertically extending between a lower intake camshaft end and an upper intake camshaft end;

a exhaust cam lobe at the upper exhaust camshaft end, wherein rotation of the exhaust camshaft causes the exhaust cam lobe to operate an uppermost exhaust valve in the plurality of exhaust valves;

an intake cam lobe at the upper intake camshaft end, wherein rotation of the intake camshaft causes the intake cam lobe to cam open an uppermost intake valve in the plurality of intake valves;

upper cam bearing bulkheads that support rotation of the upper exhaust camshaft end and upper intake camshaft end;

a lubricant circuit extending through the exhaust camshaft and the intake camshaft, the lubricant circuit having a first lubricant outlet located at the upper exhaust camshaft end and a second lubricant outlet located at the upper intake camshaft end, wherein the first and second lubricant outlets are configured to disperse lubricant onto the uppermost exhaust valve and intake valve, respectively, which is located above the upper cam bearing bulkheads.

21. An outboard marine engine comprising:

a vertically aligned bank of piston cylinders;

a camshaft that operates a plurality of valves for controlling flow of air with respect to the vertically aligned bank of piston cylinders, the camshaft vertically extending between a lower camshaft end and an upper camshaft end;

a cam lobe at the upper camshaft end, wherein rotation of the camshaft causes the cam lobe to operate an uppermost valve in the plurality of valves;

a lubricant circuit extending through the camshaft and having a lubricant outlet located at the upper camshaft end, wherein the lubricant outlet is configured to disperse lubricant onto the uppermost valve;

wherein the uppermost valve comprises a valve bucket that is cammingly engaged by the cam lobe during rotation of the camshaft, and wherein the lubricant circuit is configured to disperse the lubricant onto the valve bucket.

* * * * *